US010621931B2

(12) United States Patent
Kang

(10) Patent No.: US 10,621,931 B2
(45) Date of Patent: Apr. 14, 2020

(54) METHOD, DISPLAY APPARATUS AND APPARATUS FOR DRIVING DISPLAY APPARATUS BY ADJUSTING RED, GREEN AND BLUE GAMMA AND ADJUSTING GREEN AND BLUE LIGHT SOURCES

(71) Applicants: HKC Corporation Limited, Shuitian Village, Shiyan Sub-district (CN); Chongqing HKC Optoelectronics Technology Co., Ltd., Chongqing (CN)

(72) Inventor: Chih-Tsung Kang, Chongqing (CN)

(73) Assignees: HKC CORPORATION LIMITED, Shenzhen, Guangdong (CN); CHONGQING HKC OPTOELECTRONICS TECHNOLOGY CO., LTD., Chongqing, (CN)

( * ) Notice: Subject to any disclaimer, the term of this patent is extended or adjusted under 35 U.S.C. 154(b) by 1 day.

(21) Appl. No.: 16/064,789

(22) PCT Filed: Jan. 23, 2018

(86) PCT No.: PCT/CN2018/073760
§ 371 (c)(1),
(2) Date: Jun. 21, 2018

(87) PCT Pub. No.: WO2019/119601
PCT Pub. Date: Jun. 27, 2019

(65) Prior Publication Data

US 2019/0206345 A1 Jul. 4, 2019

(30) Foreign Application Priority Data

Dec. 21, 2017 (CN) ..... 2017 1 1394076

(51) Int. Cl.
*G09G 3/36* (2006.01)
*G09G 3/34* (2006.01)

(52) U.S. Cl.
CPC ..... *G09G 3/3607* (2013.01); *G09G 3/3413* (2013.01); *G09G 3/3406* (2013.01);
(Continued)

(58) Field of Classification Search
CPC .. G09G 3/3648; G09G 3/3406; G09G 3/3413; G09G 3/3607; G09G 2320/0276;
(Continued)

(56) References Cited

U.S. PATENT DOCUMENTS 7,259,769 B2 * 8/2007 Diefenbaugh ..... G09G 3/3413 345/591
2005/0200580 A1 9/2005 Li et al.
(Continued)

FOREIGN PATENT DOCUMENTS

CN 101739973 A 6/2010
CN 102355561 A 2/2012
(Continued)

OTHER PUBLICATIONS

International Search Report and Written Opinion dated Sep. 27, 2018, in International Application No. PCT/CN2018/073760.

*Primary Examiner* — Darlene M Ritchie
(74) *Attorney, Agent, or Firm* — Muncy, Geissler, Olds & Lowe, P.C.

(57) ABSTRACT

This application relates to a method and an apparatus for driving a display apparatus and a display apparatus. The method for driving a display apparatus includes: calculating average signals of sub pixel units in a zone to obtain a zone red average signal, a zone green average signal, and a zone blue average signal; separately performing a green adjustment and a blue gamma adjustment according to grayscale
(Continued)

corresponding predefined ranges of the red, green, and blue average signals; and adjusting luminances of corresponding green light source and blue light sources. Color brightness of red in a large viewing angle can be improved while performance of an original color signal can be maintained.

17 Claims, 7 Drawing Sheets

(52) U.S. Cl.
CPC ..... *G09G 2320/0242* (2013.01); *G09G 2320/0276* (2013.01); *G09G 2320/0626* (2013.01); *G09G 2320/0666* (2013.01); *G09G 2320/0673* (2013.01); *G09G 2360/16* (2013.01)

(58) Field of Classification Search
CPC ..... G09G 2320/0673; G09G 2320/028; G09G 2320/068; G09G 2300/0447; G09G 2300/0443; G09G 3/20; G09G 3/36; G09G 3/2007; G09G 2320/0626; G09G 2320/0666; G09G 2320/0242; G09G 2360/16
See application file for complete search history.

(56) References Cited

U.S. PATENT DOCUMENTS

2009/0213053 A1* 8/2009 Naruse ..... G09G 3/3648 345/88
2009/0289962 A1* 11/2009 Jun ..... G09G 3/3413 345/690
2011/0254879 A1* 10/2011 Mori ..... G09G 3/3607 345/690
2012/0086743 A1* 4/2012 Shiomi ..... G02F 1/136213 345/694
2014/0253422 A1* 9/2014 Tomizawa ..... G02F 1/133514 345/88
2015/0042691 A1* 2/2015 Gong ..... G09G 3/3413 345/690
2015/0221267 A1* 8/2015 Yoshida ..... G09G 3/3607 345/694
2017/0084232 A1* 3/2017 Yang ..... G09G 3/3426
2017/0110064 A1* 4/2017 Zhang ..... G09G 3/2018
2017/0154587 A1* 6/2017 Chen ..... G09G 3/2003
2017/0249890 A1* 8/2017 Yoo ..... G09G 3/2074
2017/0330520 A1* 11/2017 Tien ..... G09G 3/3607
2018/0211633 A1* 7/2018 Peng ..... G09G 5/10

FOREIGN PATENT DOCUMENTS

CN 106205555 A 12/2016
KR 100807054 B1 2/2008

* cited by examiner

| | Dark skin | Bright skin | Blue | Green | Red | Yellow | Fuchsin | Cyan | Grayscale |
|---|---|---|---|---|---|---|---|---|---|
| Shifting value | 0.031 | 0.019 | 0.087 | 0.046 | 0.081 | 0.025 | 0.039 | 0.028 | 0.004 |

METHOD, DISPLAY APPARATUS AND APPARATUS FOR DRIVING DISPLAY APPARATUS BY ADJUSTING RED, GREEN AND BLUE GAMMA AND ADJUSTING GREEN AND BLUE LIGHT SOURCES

BACKGROUND

Technical Field

This application relates to a method for designing a display panel, and in particular, to a method and an apparatus for driving a display apparatus and a display apparatus.

Related Art

A liquid-crystal display (LCD) is a flat thin display apparatus, is formed by a number of color or black and white pixels, and is disposed in front of a light source or a reflecting surface. Each pixel is formed by the following parts: a liquid crystal molecular layer suspending between two transparent electrodes, and two polarization filters, with polarization directions perpendicular to each other, disposed on two outer sides. If there is no liquid crystal between the electrodes, when light passes through one of the polarization filters, a polarization direction of the light is completely perpendicular to the second polarization filter, and therefore the light is completely blocked. However, if the polarization direction of the light passing through one of the polarization filters is rotated by liquid crystals, the light can pass through the other polarization filter. Rotation of the polarization direction of the light by the liquid crystals may be controlled by means of an electrostatic field, so as to implement control on the light.

Before charges are applied to transparent electrodes, arrangement of liquid crystal molecules is determined by arrangement on surfaces of the electrodes. Surfaces of chemical substances of the electrodes may be used as seed crystals of crystals. In most common twisted nematic (TN) liquid crystals, two electrodes above and below liquid crystals are vertically arranged. Liquid crystal molecules are arranged in a spiral manner. A polarization direction of light passing through one of polarization filters rotates after the light passes through a liquid crystal sheet, so that the light can pass through the other polarization filter. In this process, a small part of light is blocked by the polarization filter, and looks gray when being seen from outside. After the charges are applied to the transparent electrodes, the liquid crystal molecules are arranged in a manner of being almost completely arranged in parallel along an electric field direction. Therefore, a polarization direction of light passing through one of polarization filters does not rotate, and therefore the light is completely blocked. In this case, a pixel looks black. A twisting degree of arrangement of the liquid crystal molecules can be controlled by means of voltage control, so as to achieve different grayscales.

Because liquid crystals do not have colors themselves, a color filter is used to generate various colors, and is a key component for turning grayscales into colors of an LCD. A backlight module in the LCD provides a light source, and then grayscale display is formed by means of a drive IC and liquid crystal control, and the light source passes through a color resist layer of the color filter to form a color display image.

SUMMARY

To resolve the foregoing technical problem, an objective of this application is to provide a method for designing a display panel, and in particular, to a method for driving a display apparatus, including: calculating average signals of sub pixel units in a zone to obtain a zone red average signal, a zone green average signal, and a zone blue average signal; separately performing a green adjustment and a blue gamma adjustment according to grayscale corresponding predefined ranges of the red, green, and blue average signals; and adjusting luminances of corresponding green light source and blue light sources.

The objective of this application is achieved and the technical problem of this application is resolved by using the following technical solutions.

The objective of this application may further be achieved and the technical problem of this application may further be resolved by using the following technical solutions.

Another objective of this application is to provide an apparatus for driving a display apparatus, including at least one zone, where each zone is formed by a plurality of pixel units, and each pixel unit is formed by a red sub pixel unit, a green sub pixel unit, and a blue sub pixel unit, and including: calculating average signals of sub pixel units in a zone to obtain a zone red average signal, a zone green average signal, and a zone blue average signal; separately performing a green adjustment and a blue gamma adjustment according to grayscale corresponding predefined ranges of the red, green, and blue average signals; and adjusting luminances of corresponding green light source and blue light sources.

Still another objective of this application is to provide a display apparatus, including a display apparatus and the foregoing apparatus for driving a display apparatus. The drive apparatus transmits an image signal to the display panel.

In an embodiment of this application, according to the method, regarding grayscales of the average signals, when a grayscale of the zone red average signal is a first value grayscale in a predefined range, and grayscales of the zone green average signal and the zone blue average signal are a second value grayscale in the predefined range, green and blue gammas ($\gamma$) are adjusted from original $\gamma G$ and $\gamma B$ to $\gamma G1$ and $\gamma B1$, where $\gamma G1<\gamma G$ and $\gamma B1<\gamma B$, or the green and blue gammas ($\gamma$) are adjusted from the original $\gamma G$ and $\gamma B$ to $\gamma G1$ and $\gamma B1$, where $G1>\gamma G$ and $\gamma B1>\gamma B$.

In an embodiment of this application, according to the method, the first value grayscale and the second value grayscale in the predefined range are selected from the following groups: a first group: when the first value grayscale is in a range of 255 to 200, the second value grayscale is in a range of 50 to 200, where the green and blue gammas ($\gamma$) are adjusted from the original $\gamma G$ and $\gamma B$ to $\gamma G1$ and $\gamma B1$, where $\gamma G1<\gamma G$ and $\gamma B1<\gamma B$; a first group: when the first value grayscale is in a range of 255 to 200, the second value grayscale is in a range of 0 to 50, where the green and blue gammas ($\gamma$) are adjusted from the original $\gamma G$ and $\gamma B$ to $\gamma G1$ and $\gamma B1$, where $\gamma G1>\gamma G$ and $\gamma B1>\gamma B$; a second group: when the first value grayscale is in a range of 200 to 150, the second value grayscale is in a range of 50 to 200, where the green and blue gammas ($\gamma$) are adjusted from the original $\gamma G$ and $\gamma B$ to $\gamma G1$ and $\gamma B1$, where $\gamma G1<\gamma G$ and $\gamma B1<\gamma B$; a second group: when the first value grayscale is in a range of 200 to 150, the second value grayscale is in a range of 0 to 50, where the green and blue gammas ($\gamma$) are adjusted from the original $\gamma G$ and $\gamma B$ to $\gamma G1$ and $\gamma B1$, where $\gamma G1>\gamma G$ and $\gamma B1>\gamma B$; a third group: when the first value grayscale is in a range of 150 to 100, the second value grayscale is in a range of 40 to 150, where the green and blue gammas ($\gamma$) are adjusted from the original $\gamma G$ and $\gamma B$ to $\gamma G1$ and $\gamma B1$, where γG1<γG and γB1<γB; a third group: when the first value grayscale is in a range of 150 to 100, the second value grayscale is in a range of 0 to 40, where the green and blue gammas (γ) are adjusted from the original γG and γB to γG1 and γB1, where γG1>γG and γB1>γB; a fourth group: when the first value grayscale is in a range of 100 to 50, the second value grayscale is in a range of 30 to 100, where the green and blue gammas (γ) are adjusted from the original γG and γB to γG1 and γB1, where γG1<γG and γB1<γB; a fourth group: when the first value grayscale is in a range of 100 to 50, the second value grayscale is in a range of 0 to 30, where the green and blue gammas (γ) are adjusted from the original γG and γB to γG1 and γB1, where γG1>γG and γB1>γB; a fifth group: when the first value grayscale is in a range of 50 to 0, the second value grayscale is in a range of 25 to 50, where the green and blue gammas (γ) are adjusted from the original γG and γB to γG1 and γB1, where γG1<γG and γB1<γB; and a fifth group: when the first value grayscale is in a range of 50 to 0, the second value grayscale is in a range of 0 to 25, where the green and blue gammas (γ) are adjusted from the original γG and γB to γG1 and γB1, where γG1>γG and γB1>γB.

In an embodiment of this application, according to the method, the green and blue gammas are adjusted, so that luminances corresponding to green and blue grayscales decrease, and luminance decrease calculation formulas are L'G(g)=LG(255)*(g/255)γG1, and L'B(g)=LB(255)*(g/255)γB1, where grayscale g represents any grayscale.

In an embodiment of this application, according to the method, a calculation formula for adjusting a luminance corresponding to a green light source is: A'n,m_G/An,m_G=LG(Ave_Gn,m)/L'G(Ave_Gn,m)=LG(255)*(Ave_Gn,m/255)γG/LG(255)*(Ave Gn,m/255)γG1; and a calculation formula for adjusting a luminance corresponding to a blue light source is: A'n,m_B/An,m_B=LB(Ave_Bn,m)/L'B(Ave_Bn,m)=LB(255)*(Ave_Bn,m/255)γB/LB(255)*(Ave_Bn,m/255)γB1, where A'n,m_G is an adjusted green light source luminance signal, An,m_G is an initial green light source luminance signal, Ave_Gn,m is a calculated average signal of all green sub pixel units in the zone, A'n,m_B is an adjusted blue light source luminance signal, An,m_B is an initial blue light source luminance signal, Ave_Bn,m is a calculated average signal of all blue sub pixel units in the zone, and n and m are a column and a row where the zone is located.

In an embodiment of this application, according to the structure, regarding grayscales of the average signals, when a grayscale of the zone green average signal is a first value grayscale in a predefined range, and grayscales of the zone red average signal and the zone blue average signal are a second value grayscale in the predefined range, green and blue gammas (γ) are adjusted from original γG and γB to γG1 and γB1, where γG1<γG and γB1<γB, or the green and blue gammas (γ) are adjusted from the original γG and γB to γG1 and γB1, where G1>γG and γB1>γB; the first value grayscale and the second value grayscale in the predefined range are selected from the following groups: a first group: when the first value grayscale is in a range of 255 to 200, the second value grayscale is in a range of 50 to 200, where the green and blue gammas (γ) are adjusted from the original γG and γB to γG1 and γB1, where γG1<γG and γB1<γB; a first group: when the first value grayscale is in a range of 255 to 200, the second value grayscale is in a range of 0 to 50, where the green and blue gammas (γ) are adjusted from the original γG and γB to γG1 and γB1, where γG1>γG and γB1>γB; a second group: when the first value grayscale is in a range of 200 to 150, the second value grayscale is in a range of 50 to 200, where the green and blue gammas (γ) are adjusted from the original γG and γB to γG1 and γB1, where γG1<γG and γB1<γB; a second group: when the first value grayscale is in a range of 200 to 150, the second value grayscale is in a range of 0 to 50, where the green and blue gammas (γ) are adjusted from the original γG and γB to γG1 and γB1, where γG1>γG and γB1>γB; a third group: when the first value grayscale is in a range of 150 to 100, the second value grayscale is in a range of 40 to 150, where the green and blue gammas (γ) are adjusted from the original γG and γB to γG1 and γB1, where γG1<γG and γB1<γB; a third group: when the first value grayscale is in a range of 150 to 100, the second value grayscale is in a range of 0 to 40, where the green and blue gammas (γ) are adjusted from the original γG and γB to γG1 and γB1, where γG1>γG and γB1>γB; a fourth group: when the first value grayscale is in a range of 100 to 50, the second value grayscale is in a range of 30 to 100, where the green and blue gammas (γ) are adjusted from the original γG and γB to γG1 and γB1, where γG1<γG and γB1<γB; a fourth group: when the first value grayscale is in a range of 100 to 50, the second value grayscale is in a range of 0 to 30, where the green and blue gammas (γ) are adjusted from the original γG and γB to γG1 and γB1, where γG1>γG and γB1>γB; a fifth group: when the first value grayscale is in a range of 50 to 0, the second value grayscale is in a range of 25 to 50, where the green and blue gammas (γ) are adjusted from the original γG and γB to γG1 and γB1, where γG1<γG and γB1<γB; and a fifth group: when the first value grayscale is in a range of 50 to 0, the second value grayscale is in a range of 0 to 25, where the green and blue gammas (γ) are adjusted from the original γG and γB to γG1 and γB1, where γG1>γG and γB1>γB.

In an embodiment of this application, according to the structure, the green and blue gammas are adjusted, so that luminances corresponding to green and blue grayscales decrease, and luminance decrease calculation formulas are L'G(g)=LG(255)*(g/255)γG1, and L'B(g)=LB(255)*(g/255)γB1, where grayscale g represents any grayscale.

In an embodiment of this application, according to the structure, a calculation formula for adjusting a luminance corresponding to a green light source is:

$$A'n,m_G/An,m_G=LG(Ave_Gn,m)/L'G(Ave_Gn,m)=LG(255)*(Ave_Gn,m/255)\gamma G/LG(255)*(Ave_Gn,m/255)\gamma G1;$$

a calculation formula for adjusting a luminance corresponding to a blue light source is:

$$A'n,m_B/An,m_B=LB(Ave_Bn,m)/L'B(Ave_Bn,m)=LB(255)*(Ave_Bn,m/255)\gamma B/LB(255)*(Ave_Bn,m/255)\gamma B1,\text{ where}$$

A'n,m_G is an adjusted green light source luminance signal, An,m_G is an initial green light source luminance signal, Ave_Gn,m is a calculated average signal of all green sub pixel units in the zone, A'n,m_B is an adjusted blue light source luminance signal, An,m_B is an initial blue light source luminance signal, Ave_Bn,m is a calculated average signal of all blue sub pixel units in the zone, and n and m are a column and a row where the zone is located.

According to this application, a grayscale drive method for improving a color cast of a red hue in a large viewing angle is used, that is, by determining an interval of average grayscales of green and blue, and by adjusting green and blue input gamma signals, the green and blue input gamma signals are turned down or turned up, so that green and blue signal luminances increase or decrease, and a mixed color changes from a red hue to a neutral color hue or a ratio of a red signal to green and blue is strengthened. Then, by means of compensation for luminance signal decrease or increase of green and blue light emitting diodes (LEDs), a color viewed in front can be maintained same as the original red hue color, and performance of the original color is not affected by adjustment of green and blue gamma signals. Color brightness of red in a large viewing angle can be improved while performance of an original color signal can be maintained.

DETAILED DESCRIPTION

Figure 1:
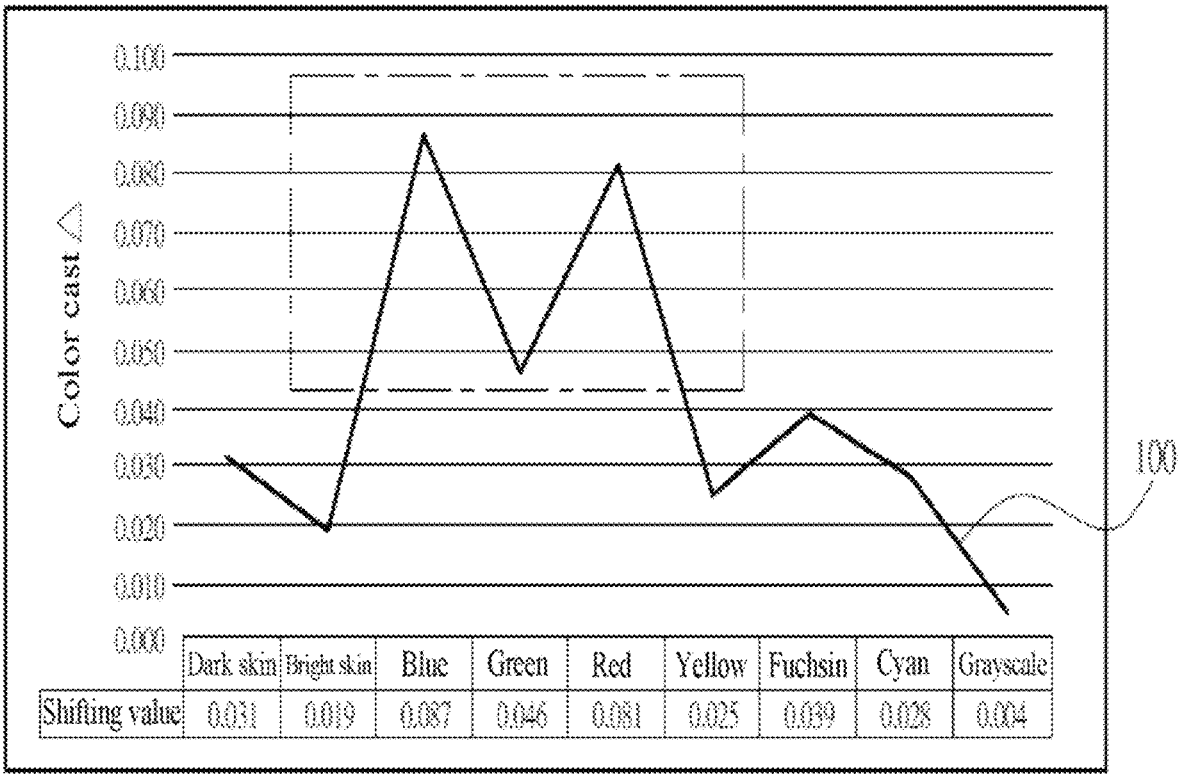
FIG. 1 is a diagram of a relationship between a color system and a color cast of an exemplary LCD before color cast adjustment.

The following embodiments are described with reference to the accompanying drawings, used to exemplify specific embodiments for implementation of this application. Terms about directions mentioned in this application, such as "on", "below", "front", "back", "left", "right", "in", "out", and "side surface" merely refer to directions in the accompanying drawings. Therefore, the used terms about directions are used to describe and understand this application, and are not intended to limit this application.

The accompanying drawings and the description are considered to be essentially exemplary, rather than limitative. In the figures, units with similar structures are represented by a same reference number. In addition, for understanding and ease of description, the size and the thickness of each component shown in the accompanying drawings are randomly shown, but this application is not limited thereto.

In the accompanying drawings, for clarity, thicknesses of a layer, a film, a panel, an area, and the like are enlarged. In the accompanying drawings, for understanding and ease of description, thicknesses of some layers and areas are enlarged. It should be understood that, for example, when a component such as a layer, a film, an area, or a base is described to be "on" "another component", the component may be directly on the another component, or there may be an intermediate component.

In addition, throughout this specification, unless otherwise explicitly described to have an opposite meaning, the word "include" is understood as including the component, but not excluding any other component. In addition, throughout this specification, "on" means that one is located above or below a target component and does not necessarily mean that one is located on the top based on a gravity direction.

To further describe technical means used in this application to achieve a preset inventive objective and technical effects of this application, specific implementations, structures, features, and effects of a method and an apparatus for driving a display apparatus and a display apparatus provided according to this application are described in detail below with reference to the accompanying drawings and preferred embodiments.

The display apparatus of this application includes a display panel and a backlight module disposed opposite to each other. The display panel mainly includes a color filter substrate, an active array substrate, and a liquid crystal layer sandwiched between the two substrates. The color filter substrate, the active array substrate, and the liquid crystal layer may form a plurality of pixel units configured in an array. The backlight module may emit light rays penetrating through the display panel, and display colors by using each pixel unit of the display panel, to form an image.

In an embodiment, the display panel of this application may be a curved-surface display panel, and the display apparatus of this application may also be a curved-surface display apparatus.

Currently, in improvement of a wide viewing angle technology of a vertical alignment (VA) display panel, manufacturers of display apparatuses have developed a photo-alignment technology to control an alignment direction of liquid crystal molecules, thereby improving optical performance and yield of a display panel. The photo-alignment technology is to form multi-domain alignment in each pixel unit of a panel, so that liquid crystal molecules in a pixel unit tilt towards, for example, four different directions. The photo-alignment technology is to irradiate a polymer thin film (an alignment layer) of a color filter substrate or a thin film transistor substrate by using an ultraviolet light source (for example, polarized light), so that polymer structures on a surface of the thin film perform non-homogeneous photopolymerization, isomerization, or pyrolysis, inducing chemical bond structures on the surface of the thin film generate special directivities, so as to further induce forward-only arrangement of liquid crystal molecules, thereby performing photo-alignment.

According to different orientation manners of liquid crystals, currently, display panels on a mainstream market may be divided into the following types: a VA type, a TN or super twisted nematic (STN) type, an in-plane switching (IPS) type, and a fringe field switching (FFS) type. Displays of a VA mode include, for example, a patterned vertical alignment (PVA) display or a multi-domain vertical alignment (MVA) display apparatus. The PVA display achieves a wide viewing angle effect by using a fringing field effect and a compensation plate. The MVA display apparatus divides one pixel into a plurality of areas, and makes, by using a protrusion or a particular pattern structure, liquid crystal molecules in different areas tilt towards different directions, to achieve a wide viewing angle and improve a penetration transmittance. In an IPS mode or an FFS mode, by applying an electric field including components approximately parallel to a substrate, liquid crystal molecules make responses in a direction parallel to a plane of the substrate and are driven. An IPS display panel and an FFS display panel have advantages of wide viewing angles.

FIG. 1 is a diagram of a relationship between a color system and a color cast of an exemplary LCD before color cast adjustment. Referring to FIG. 1, in an LCD, due to correlation between a refractive index and a wavelength, transmittances of different wavelengths are related to phase delays of different wavelengths, and transmittances have different performances according to different wavelengths. In addition, with drive of a voltage, phase delays of different wavelengths also generate changes of different degrees, affecting performances of transmittances of different wavelengths. FIG. 1 shows changes of color casts between large viewing angles and front viewing angles of various representative color systems of an LCD. It can be obviously found that conditions of color casts 100 of large viewing angles of color systems of red, green, and blue hues are all more severe than those of other color systems. Therefore, overcoming color cast defects of the red, green, and blue hues can greatly improve an overall color cast of a large viewing angle. Therefore, when a color mixed hue of red, green, and blue is approximate to a black and white neutral hue, a phenomenon of a viewing angle color cast obviously decreases. Therefore, an algorithm of viewing angle color cast compensation is developed by means of such an attribute in cooperation with independent light source control of red, green, and blue LEDs.

Figure 2:
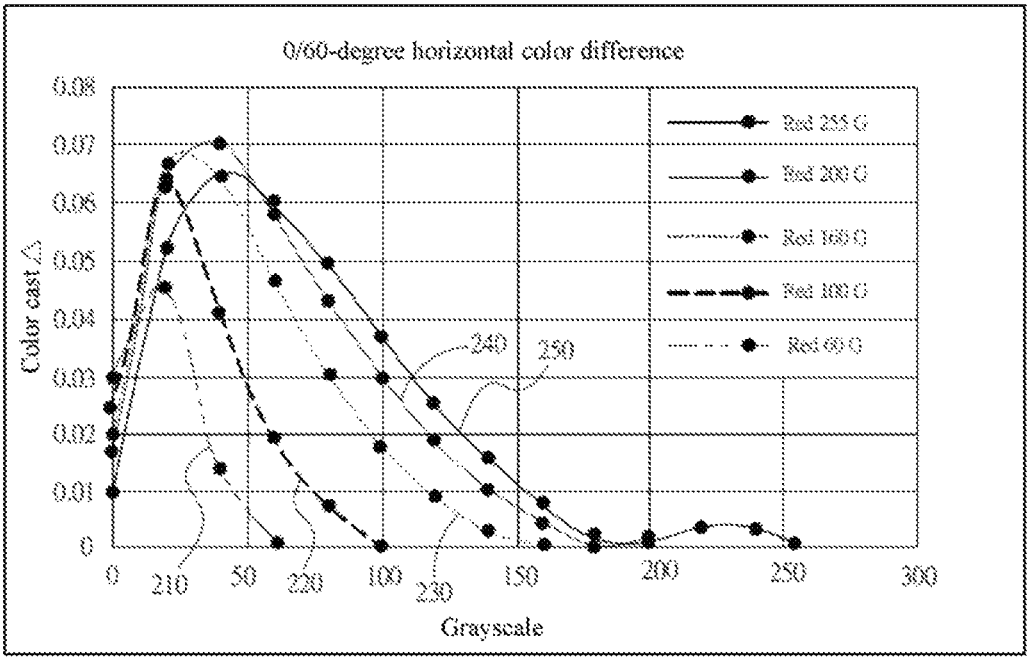
FIG. 2 is a diagram of a relationship between a green color cast and a grayscale of an LCD before color cast adjustment according to an embodiment of this application.
Figure 3:
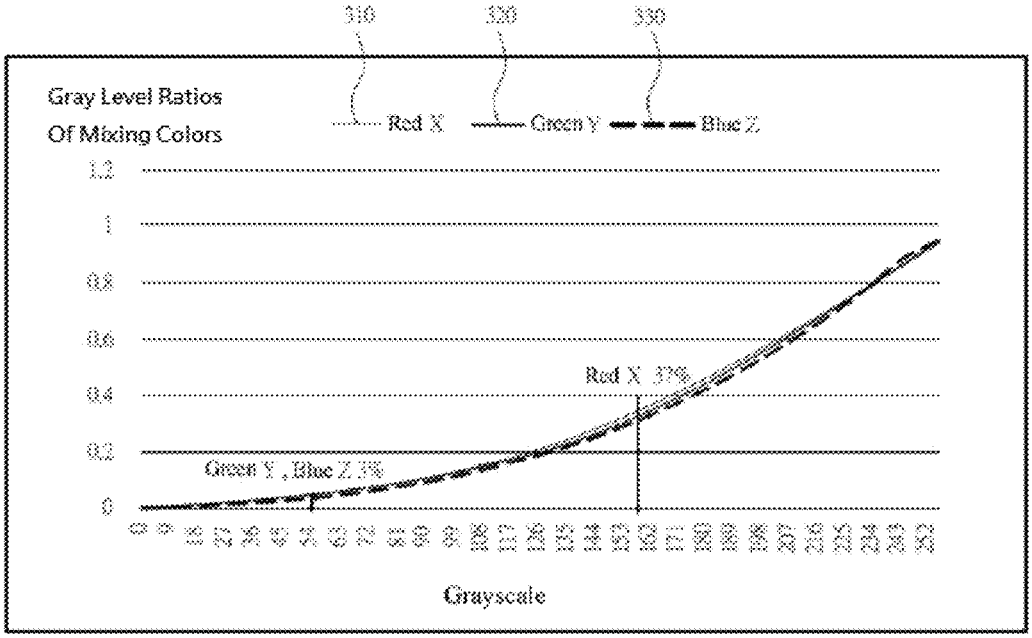
FIG. 3 is a diagram of a relationship between red X, green Y, and blue Z of red, green, and blue in a front viewing angle and a grayscale of an LCD before color cast adjustment according to an embodiment of this application.
Figure 4:
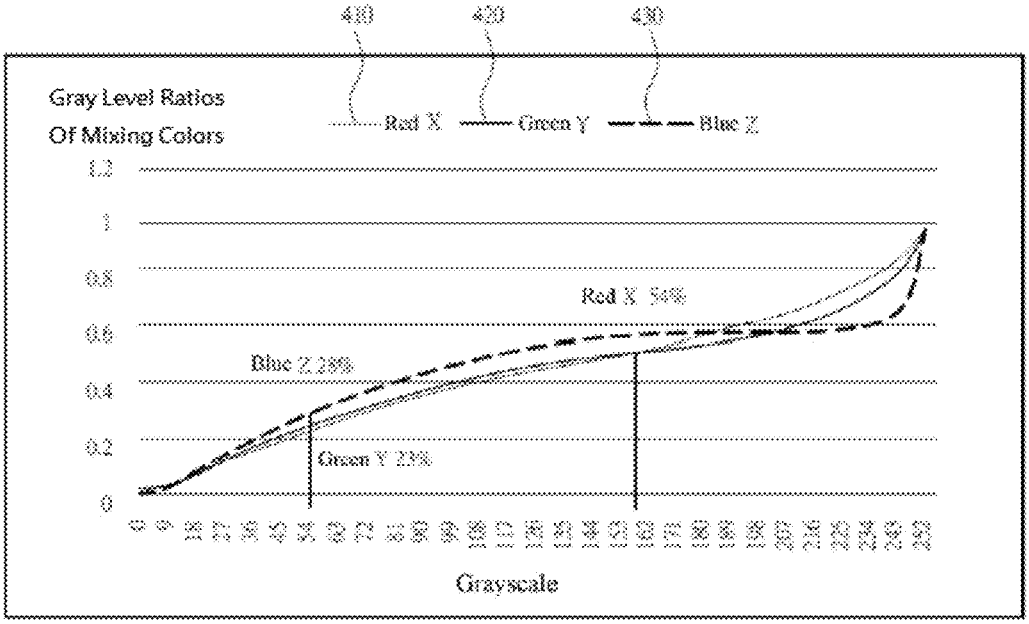
FIG. 4 is a diagram of a relationship between red X, green Y, and blue Z of red, green, and blue in a large viewing angle and a grayscale of an LCD before color cast adjustment according to an embodiment of this application.

FIG. 2 is a diagram of a relationship between a green color cast and a grayscale of an LCD before color cast adjustment according to an embodiment of this application. FIG. 3 is a diagram of a relationship between red X, green Y, and blue Z of red, green, and blue in a front viewing angle and a grayscale of an LCD before color cast adjustment according to an embodiment of this application. FIG. 4 is a diagram of a relationship between red X, green Y, and blue Z of red, green, and blue in a large viewing angle and a grayscale of an LCD before color cast adjustment according to an embodiment of this application. Referring to FIG. 2, FIG. 2 shows viewing angle color difference change conditions of a front viewing angle and a 60-degree horizontal viewing angle under different color mixing conditions of a red system. When a red grayscale is in a range of 255 to 250, green and blue grayscales are in a range of 0 to 255. A lower grayscale signal of green and blue indicates a severe color cast of the red hue. When the red grayscale is in a range of 200 to 240, the green and blue grayscales are in a range of 0 to 180. A lower grayscale signal of green and blue indicates a severe color cast of the red hue. When the red grayscale is in a range of 160 to 230, the green and blue grayscales are in a range of 0 to 160. A lower grayscale signal of green and blue indicates a severe color cast of the red hue. When the red grayscale is in a range of 100 to 220, the green and blue grayscales are in a range of 0 to 100. A lower grayscale signal of green and blue indicates a severe color cast of the red hue. Moreover, when the red grayscale is in a range of 200 to 240 and a color mixed grayscale of green and blue is approximate to a red grayscale 200, the hue is obviously improved, and at the moment, a mixed color is approximate to a neutral white system. In addition, the color mixed grayscale of green and blue is less than a grayscale 50, and with decrease of the color mixed grayscale of green and blue, a color cast of a large viewing angle of the red hue may also be reduced. Therefore, the red hue color mixed viewing angle color cast may be first reduced by compensating, by means of the color mixed grayscale of green and blue, for signals.

Refer to FIG. 3, FIG. 4, and the following descriptions for a color cast. For example, grayscales of a mixed color in a front viewing angle are red 160, green 50, and blue 50; and grayscale ratios of red X, green Y, blue Z to full grayscales red 255, green 255, and blue 255 in a corresponding front viewing angle are 37%, 3%, and 3% in color mixing (310, 320, 330), and grayscale ratios of red X, green Y, and blue Z to full grayscales red 255, green 255, and blue 255 in a corresponding large viewing angle are 54%, 23%, and 28% in color mixing (410, 420, 430). Ratios of red X, green Y, and blue Z in the mixed color in the front viewing angle are different from those of red X, green Y, and blue Z in a mixed color in the large viewing angle. Consequently, luminance ratios of green Y and blue Z to the red X in the original front viewing angle are considerably small, and luminance ratios of green Y and blue Z to the red X in the large viewing angle are non-neglectable. Therefore, a red hue in the large viewing angle is not as bright as a red hue in the front viewing angle, and has an obvious color cast.

Figure 5:
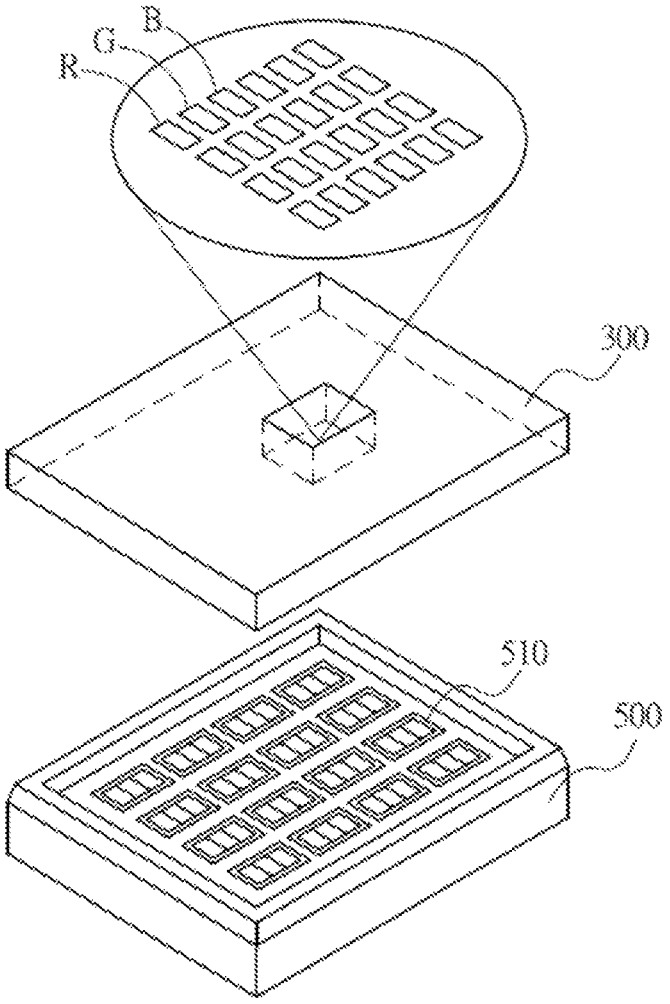
FIG. 5 is a schematic diagram of an apparatus for driving a display apparatus according to an embodiment of this application.
Figure 6:
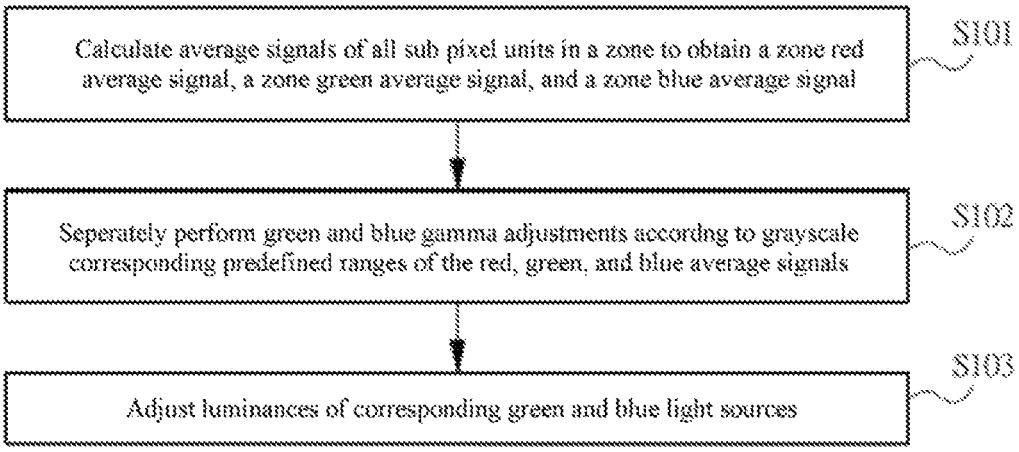
FIG. 6 is a flowchart of a method for driving a display apparatus according to an embodiment of this application.

FIG. 5 is a schematic diagram of an apparatus for driving a display apparatus according to an embodiment of this application and FIG. 6 is a flowchart of a method for driving a display apparatus according to an embodiment of this application. Referring to FIG. 5, according to an embodiment of this application, an apparatus 500 for driving a display apparatus includes a plurality of red, green, and blue sub pixels. Each group of red, green, and blue sub pixels is referred to as a pixel unit 510. Each pixel unit represents an image signal. In this application, an LCD is divided into a plurality of zones. Each zone 300 is formed by a plurality of pixel units. The size of the zone may be self-defined. The LCD may be divided into columns*rows (N*M), and a plurality of zones 300 formed by pixel units 510.

In the apparatus for driving a display apparatus of this application, a zone red average signal, a zone green average signal, and a zone blue average signal are obtained by calculating average signals of sub pixel units in a zone, and then a green adjustment and a blue gamma adjustment are separately performed according to grayscale corresponding predefined ranges of the red, green, and blue average signals, and luminances of corresponding green light source and blue light sources are adjusted, so that correctness of a color viewed in front can be maintained and defects of viewing angle color casts can be overcome.

Referring to FIG. 5, in an embodiment, an apparatus 500 for driving a display apparatus includes at least one zone 300. Each zone 300 is formed by a plurality of pixel units 510. Each pixel unit 510 is formed by a red sub pixel unit, a green sub pixel unit, and a blue sub pixel unit, and includes: calculating average signals of sub pixel units in a zone 300 to obtain a zone red average signal, a zone green average signal, and a zone blue average signal; separately performing a green adjustment and a blue gamma adjustment according to grayscale corresponding predefined ranges of the red, green, and blue average signals; and adjusting luminances of corresponding green light source and blue light sources.

In an embodiment, regarding grayscales of the average signals, when a grayscale of the zone green average signal is a first value grayscale in a predefined range, and grayscales of the zone red average signal and the zone blue average signal are a second value grayscale in the predefined range, green and blue gammas (γ) are adjusted from original γG and γB to γG1 and γB1, where γG1<γG and γB1<γB, or the green and blue gammas (γ) are adjusted from the original γG and γB to γG1 and γB1, where G1>γG and γB1>γB. The first value grayscale and the second value grayscale in the predefined range are selected from the following groups: a first group: when the first value grayscale is in a range of 255 to 200, the second value grayscale is in a range of 50 to 200, where the green and blue gammas (γ) are adjusted from the original γG and γB to γG1 and γB1, where γG1<γG and γB1<γB; a first group: when the first value grayscale is in a range of 255 to 200, the second value grayscale is in a range of 0 to 50, where the green and blue gammas (γ) are adjusted from the original γG and γB to γG1 and γB1, where γG1>γG and γB1>γB; a second group: when the first value grayscale is in a range of 200 to 150, the second value grayscale is in a range of 50 to 200, where the green and blue gammas (γ) are adjusted from the original γG and γB to γG1 and γB1, where γG1<γG and γB1<γB; a second group: when the first value grayscale is in a range of 200 to 150, the second value grayscale is in a range of 0 to 50, where the green and blue gammas (γ) are adjusted from the original γG and γB to γG1 and γB1, where γG1>γG and γB1>γB; a third group: when the first value grayscale is in a range of 150 to 100, the second value grayscale is in a range of 40 to 150, where the green and blue gammas (γ) are adjusted from the original γG and γB to γG1 and γB1, where γG1<γG and γB1<γB; a third group: when the first value grayscale is in a range of 150 to 100, the second value grayscale is in a range of 0 to 40, where the green and blue gammas (γ) are adjusted from the original γG and γB to γG1 and γB1, where γG1>γG and γB1>γB; a fourth group: when the first value grayscale is in a range of 100 to 50, the second value grayscale is in a range of 30 to 100, where the green and blue gammas (γ) are adjusted from the original γG and γB to γG1 and γB1, where γG1<γG and γB1<γB; a fourth group: when the first value grayscale is in a range of 100 to 50, the second value grayscale is in a range of 0 to 30, where the green and blue gammas (γ) are adjusted from the original γG and γB to γG1 and γB1, where γG1>γG and γB1>γB; a fifth group: when the first value grayscale is in a range of 50 to 0, the second value grayscale is in a range of 25 to 50, where the green and blue gammas (γ) are adjusted from the original γG and γB to γG1 and γB1, where γG1<γG and γB1<γB; and a fifth group: when the first value grayscale is in a range of 50 to 0, the second value grayscale is in a range of 0 to 25, where the green and blue gammas (γ) are adjusted from the original γG and γB to γG1 and γB1, where γG1>γG and γB1>γB.

In an embodiment, the green and blue gammas are adjusted, so that luminances corresponding to green and blue grayscales decrease, and luminance decrease calculation formulas are L'G(g)=LG(255)*(g/255)γG1, and L'B(g)=LB(255)*(g/255)γB1, where grayscale g represents any grayscale.

In an embodiment, according to the structure, a calculation formula for adjusting a luminance corresponding to a green light source is:

$$A'n,m_G/An,m_G=LG(Ave_Gn,m)/L'G(Ave_Gn,m)=LG(255)*(Ave_Gn,m/255)\gamma G/LG(255)*(Ave_Gn,m/255)\gamma G1;$$

a calculation formula for adjusting a luminance corresponding to a blue light source is:

$$A'n,m_B/An,m_B=LB(Ave_Bn,m)/L'B(Ave_Bn,m)=LB(255)*(Ave_Bn,m/255)\gamma B/LB(255)*(Ave_Bn,m/255)\gamma B1, \text{ where}$$

A'n,m_G is an adjusted green light source luminance signal, An,m_G is an initial green light source luminance signal, Ave_Gn,m is a calculated average signal of all green sub pixel units in the zone, A'n,m_B is an adjusted blue light source luminance signal, An,m_B is an initial blue light source luminance signal, Ave_Bn,m is a calculated average signal of all blue sub pixel units in the zone, and n and m are a column and a row where the zone is located.

Referring to FIG. 6, FIG. 6 shows the following flows: flow S101: Calculate average signals of sub pixel units (Rn,m_i,j, Gn,m_i,j, and Bn,m_i,j) in a zone (n, m) to obtain a zone red average signal (Ave_Rn,m), a zone green average signal (Ave_Gn,m), and a zone blue average signal (Ave_Bn,m), where i and j are pixel units in the n,m zone;

flow S102: Separately perform a green adjustment and a blue gamma adjustment according to grayscale corresponding predefined ranges of the red, green, and blue average signals; and flow S103: Adjust luminances of corresponding green light source and blue light sources.

In an embodiment, the grayscale corresponding predefined ranges of the red, green, and blue average signals in flow S102 are: when a grayscale of the zone red average signal is in a range of 255 to 200 of the predefined range, and grayscales of the zone green average signal and the zone blue average signal are in a range of 50 to 200 of the predefined range, green and blue gammas (γ) are adjusted from original γG and γB to γG1 and γB1, where γG1<γG and γB1<γB; or when the grayscale of the zone red average signal is in a range of 255 to 200 of the predefined range, and the grayscales of the zone green average signal and the zone blue average signal are in a range of 0 to 50 of the predefined range, the green and blue gammas (γ) are adjusted from original γG and γB to γG1 and γB1, where γG1>γG and γB1>γB.

In an embodiment, the grayscale corresponding predefined ranges of the red, green, and blue average signals in flow S102 are: when a grayscale of the zone red average signal is in a range of 200 to 150 of the predefined range, and grayscales of the zone green average signal and the zone blue average signal are in a range of 50 to 200 of the predefined range, green and blue gammas (γ) are adjusted from original γG and γB to γG1 and γB1, where γG1<γG and γB1<γB; or when the grayscale of the zone red average signal is in a range of 200 to 150 of the predefined range, and the grayscales of the zone green average signal and the zone blue average signal are in a range of 0 to 50 of the predefined range, the green and blue gammas (γ) are adjusted from original γG and γB to γG1 and γB1, where γG1>γG and γB1>γB.

In an embodiment, the grayscale corresponding predefined ranges of the red, green, and blue average signals in flow S102 are: when a grayscale of the zone red average signal is in a range of 100 to 150 of the predefined range, and grayscales of the zone green average signal and the zone blue average signal are in a range of 40 to 150 of the predefined range, green and blue gammas (γ) are adjusted from original γG and γB to γG1 and γB1, where γG1<γG and γB1<γB; or when the grayscale of the zone red average signal is in a range of 100 to 150 of the predefined range, and the grayscales of the zone green average signal and the zone blue average signal are in a range of 0 to 40 of the predefined range, the green and blue gammas (γ) are adjusted from original γG and γB to γG1 and γB1, where γG1>γG and γB1>γB.

In an embodiment, the grayscale corresponding predefined ranges of the red, green, and blue average signals in flow S102 are: when a grayscale of the zone red average signal is in a range of 50 to 100 of the predefined range, and grayscales of the zone green average signal and the zone blue average signal are in a range of 30 to 100 of the predefined range, green and blue gammas (γ) are adjusted from original γG and γB to γG1 and γB1, where γG1<γG and γB1<γB; or when the grayscale of the zone red average signal is in a range of 50 to 100 of the predefined range, and the grayscales of the zone green average signal and the zone blue average signal are in a range of 0 to 30 of the predefined range, the green and blue gammas (γ) are adjusted from original γG and γB to γG1 and γB1, where γG1>γG and γB1>γB.

In an embodiment, the grayscale corresponding predefined ranges of the red, green, and blue average signals in flow S102 are: when a grayscale of the zone red average signal is in a range of 0 to 50 of the predefined range, and grayscales of the zone green average signal and the zone blue average signal are in a range of 25 to 50 of the predefined range, green and blue gammas (γ) are adjusted from original γG and γB to γG1 and γB1, where γG1<γG and γB1<γB; or when the grayscale of the zone red average signal is in a range of 0 to 50 of the predefined range, and the grayscales of the zone green average signal and the zone blue average signal are in a range of 0 to 25 of the predefined range, the green and blue gammas (γ) are adjusted from original γG and γB to γG1 and γB1, where γG1>γG and γB1>γB.

In the foregoing embodiments, after adjustment, green and blue gammas are improved, making luminances corresponding to green and blue grayscales decrease. Luminance decrease calculation formulas are as follows: L'G(g)=LG(255)*(g/255)γG1, less than LG(g)=LG(255)*(g/255)γG; and L'B(g)=LB(255)*(g/255)γB1, less than LB(g)=LB(255)*(g/255)γB, where grayscale g represents any grayscale.

Refer to FIG. 5 and FIG. 6. An embodiment of the present invention describes a method for driving a display apparatus. When the present invention uses backlight of a direct type LED, the backlight is divided into a plurality of zones of N (columns)*M (rows) like a display. Therefore, there are independent red, green, and blue LED light sources in each zone n,m, as described in FIG. 6. Initial luminance signals of the red, green, and blue LEDs in the zone n,m are An,m_R, An,m_G, and An,m_B. For example, when Ave_Rn,m is in a grayscale range of 255 to 200 and Ave_Gn,m and Ave_Bn are in a grayscale range of 50 to 200, to compensate for luminance increase, that is, L'G(g)=LG(255)*(Ave_Gn,m/255)γG1 is approximate to LG(g)=LG(255)*(Ave_Rn,m/255) γG, and L'B(g)=LB(255)*(Ave_Bn,m/255)γB1 is approximate to LB(g)=LB(255)*(Ave_Rn,m/255)γB, caused by adjusting green and blue gammas from original γG and γB to γG1 and γB1, where γG1<γG and γB1<γB, luminance signals of the green and blue LEDs of the zone are adjusted to decrease to A'n,m_G and A'n,m_B. Luminance adjustment ratios are: A'n,m_G/An,m_G=LG(Ave_Gn,m)/L'G(Ave_Gn,m)=LG(255)*(Ave_Gn,m/255) γG/LG(255)*(Ave_Gn,m/255)γG1 and A'n,m_B/An,m_B=LB(Ave_Bn,m)/L'B(Ave_Bn,m)=LB(255)*(Ave_Bn,m/255)γB/LB(255)*(Ave_Bn,m/255)γB1. On the other hand, when Ave_Rn,m is in a grayscale range of 255 to 200 and Ave_Gn,m and Ave_Bn are in a grayscale range of 0 to 50, to compensate for luminance decrease, that is, L'G(g)=LG(255)*(g/255)γG1<LG(g)=LG(255)*(g/255)γG and L'B(g)=LB(255)*(g/255) γB1<LB(g)=LB(255)*(g/255)γB, caused by adjusting green and blue gammas from original γG and γB to γG1 and γB1, where γG1>γG and γB1>γB, luminance signals of the green and blue LEDs of the zone are adjusted to increase to A'n,m_G and A'n,m_B. Luminance adjustment ratios are: A'n,m_G/An,m_G=LG(Ave_Gn,m)/L'G(Ave_Gn,m)=LG(255)*(Ave_Gn,m/255) γG/LG(255)*(Ave_Gn,m/255)γG1 and A'n,m_B/An,m_B=LB(Ave_Bn,m)/L'B(Ave_Bn,m)=LB(255)*(Ave_Bn,m/255)γB/LB(255)*(Ave_Bn,m/255) γB1. Therefore, by means of luminance signal compensation of green and blue LEDs, a color viewed in front can be maintained same as the original color, and performance of the original color is not affected by adjustment of green and blue gamma signals.

Referring to FIG. 5, in an embodiment, an apparatus 500 for driving a display apparatus includes at least one zone 300. Each zone 300 is formed by a plurality of pixel units 510. Each pixel unit 510 is formed by a red sub pixel unit, a green sub pixel unit, and a blue sub pixel unit, and further includes: calculating average signals of sub pixel units in a zone 300 to obtain a zone red average signal, a zone green average signal, and a zone blue average signal; separately performing a green adjustment and a blue gamma adjustment according to grayscale corresponding predefined ranges of the red, green, and blue average signals; and adjusting luminances of corresponding green light source and blue light sources. Regarding grayscales of the average signals, when a grayscale of the zone green average signal is a first value grayscale in a predefined range, and grayscales of the zone red average signal and the zone blue average signal are a second value grayscale in the predefined range, green and blue gammas (γ) are adjusted from original γG and γB to γG1 and γB1, where γG1<γG and γB1<γB, or the green and blue gammas (γ) are adjusted from the original γG and γB to γG1 and γB1, where G1>γG and γB1>γB. The first value grayscale and the second value grayscale in the predefined range are selected from the following groups: a first group: when the first value grayscale is in a range of 255 to 200, the second value grayscale is in a range of 50 to 200, where the green and blue gammas (γ) are adjusted from the original γG and γB to γG1 and γB1, where γG1<γG and γB1<γB; a first group: when the first value grayscale is in a range of 255 to 200, the second value grayscale is in a range of 0 to 50, where the green and blue gammas (γ) are adjusted from the original γG and γB to γG1 and γB1, where γG1>γG and γB1>γB; a second group: when the first value grayscale is in a range of 200 to 150, the second value grayscale is in a range of 50 to 200, where the green and blue gammas (γ) are adjusted from the original γG and γB to γG1 and γB1, where γG1<γG and γB1<γB; a second group: when the first value grayscale is in a range of 200 to 150, the second value grayscale is in a range of 0 to 50, where the green and blue gammas (γ) are adjusted from the original γG and γB to γG1 and γB1, where γG1>γG and γB1>γB; a third group: when the first value grayscale is in a range of 150 to 100, the second value grayscale is in a range of 40 to 150, where the green and blue gammas (γ) are adjusted from the original γG and γB to γG1 and γB1, where γG1<γG and γB1<γB; a third group: when the first value grayscale is in a range of 150 to 100, the second value grayscale is in a range of 0 to 40, where the green and blue gammas (γ) are adjusted from the original γG and γB to γG1 and γB1, where γG1>γG and γB1>γB; a fourth group: when the first value grayscale is in a range of 100 to 50, the second value grayscale is in a range of 30 to 100, where the green and blue gammas (γ) are adjusted from the original γG and γB to γG1 and γB1, where γG1<γG and γB1<γB; a fourth group: when the first value grayscale is in a range of 100 to 50, the second value grayscale is in a range of 0 to 30, where the green and blue gammas (γ) are adjusted from the original γG and γB to γG1 and γB1, where γG1>γG and γB1>γB; a fifth group: when the first value grayscale is in a range of 50 to 0, the second value grayscale is in a range of 25 to 50, where the green and blue gammas (γ) are adjusted from the original γG and γB to γG1 and γB1, where γG1<γG and γB1<γB; and a fifth group: when the first value grayscale is in a range of 50 to 0, the second value grayscale is in a range of 0 to 25, where the green and blue gammas (γ) are adjusted from the original γG and γB to γG1 and γB1, where γG1>γG and γB1>γB. The red sub pixel unit, the green sub pixel unit, and the blue sub pixel unit are arranged in an array.

Figure 7:
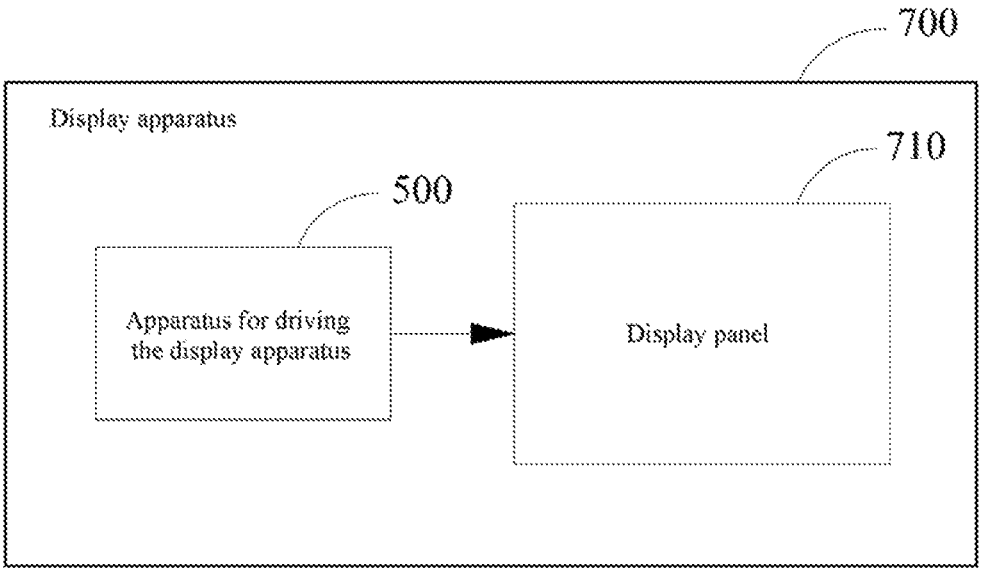
FIG. 7 is a modules diagram of a display panel according to an embodiment of this application.

FIG. 7 is a modules diagram of a display panel according to an embodiment of this application. A display apparatus 700 includes an apparatus 500 for driving the display apparatus and a display panel 710. The apparatus 50 for driving the display apparatus is connected to the display panel 710, and transmits an image signal to the display panel 710.

According to this application, a grayscale drive method for improving a color cast of a red hue in a large viewing angle is used, that is, by determining an interval of average grayscales of green and blue, and by adjusting green and blue input gamma signals, the green and blue input gamma signals are turned down or turned up, so that green and blue signal luminances increase or decrease, and a mixed color changes from a red hue to a neutral color hue or a ratio of a red signal to green and blue is strengthened. Then, by means of compensation for luminance signal decrease or increase of green and blue light emitting diodes (LEDs), a color viewed in front can be maintained same as the original red hue color, and performance of the original color is not affected by adjustment of green and blue gamma signals. Color brightness of red in a large viewing angle can be improved while performance of an original color signal can be maintained.

Phrases such as "in some embodiments" and "in various embodiments" are repeatedly used. The wordings usually refer to different embodiments, but they may also refer to a same embodiment. Words, such as "comprise", "have", and "include" are synonyms, unless other meanings are indicated in the context.

The foregoing descriptions are merely embodiments of this application, and are not intended to limit this application in any form. Although this application has been disclosed above through the embodiments, the embodiments are not intended to limit this application. Any person skilled in the art can make some variations or modifications, namely, equivalent changes, according to the foregoing disclosed technical content to obtain equivalent embodiments without departing from the scope of the technical solutions of this application. Any simple amendment, equivalent change, or modification made to the foregoing embodiments according to the technical essence of this application without departing from the content of the technical solutions of this application shall fall within the scope of the technical solutions of this application.

What is claimed is:

1. A method for driving a display apparatus, comprising:

calculating average signals of sub pixel units in a zone to obtain a zone red average signal, a zone green average signal, and a zone blue average signal;

separately performing a green gamma adjustment and a blue gamma adjustment according to grayscale corresponding predefined ranges of the red, green, and blue average signals; and adjusting luminances of corresponding green light sources and blue light sources;

wherein regarding grayscales of the average signals, when a grayscale of the zone red average signal is a first value grayscale in a predefined range, and grayscales of the zone green average signal and the zone blue average signal are a second value grayscale in the predefined range, green and blue gammas (γ) are adjusted from original γG and γB to γG1 and γB1, wherein γG1<γG and γB1<γB, or the green and blue gammas (γ) are adjusted from the original γG and γB to γG1 and γB1, wherein γG1>γG and γB1>γB.

2. The method for driving a display apparatus according to claim 1, wherein the first value grayscale and the second value grayscale in the predefined range are selected from the following groups:

a first group: when the first value grayscale is in a range of 255 to 200, the second value grayscale is in a range of 50 to 200, wherein the green and blue gammas (γ) are adjusted from the original γG and γB to γG1 and γB1, wherein γG1<γG and γB1<γB;

a first group: when the first value grayscale is in a range of 255 to 200, the second value grayscale is in a range of 0 to 50, wherein the green and blue gammas (γ) are adjusted from the original γG and γB to γG1 and γB1, wherein γG1>γG and γB1>γB;

a second group: when the first value grayscale is in a range of 200 to 150, the second value grayscale is in a range of 50 to 200, wherein the green and blue gammas (γ) are adjusted from the original γG and γB to γG1 and γB1, wherein γG1<γG and γB1<γB;

a second group: when the first value grayscale is in a range of 200 to 150, the second value grayscale is in a range of 0 to 50, wherein the green and blue gammas (γ) are adjusted from the original γG and γB to γG1 and γB1, wherein γG1>γG and γB1>γB;

a third group: when the first value grayscale is in a range of 150 to 100, the second value grayscale is in a range of 40 to 150, wherein the green and blue gammas (γ) are adjusted from the original γG and γB to γG1 and γB1, wherein γG1<γG and γB1<γB;

a third group: when the first value grayscale is in a range of 150 to 100, the second value grayscale is in a range of 0 to 40, wherein the green and blue gammas (γ) are adjusted from the original γG and γB to γG1 and γB1, wherein γG1>γG and γB1>γB;

a fourth group: when the first value grayscale is in a range of 100 to 50, the second value grayscale is in a range of 30 to 100, wherein the green and blue gammas (γ) are adjusted from the original γG and γB to γG1 and γB1, wherein γG1<γG and γB1<γB;

a fourth group: when the first value grayscale is in a range of 100 to 50, the second value grayscale is in a range of 0 to 30, wherein the green and blue gammas (γ) are adjusted from the original γG and γB to γG1 and γB1, wherein γG1>γG and γB1>γB;

a fifth group: when the first value grayscale is in a range of 50 to 0, the second value grayscale is in a range of 25 to 50, wherein the green and blue gammas (γ) are adjusted from the original γG and γB to γG1 and γB1, wherein γG1<γG and γB1<γB; and a fifth group: when the first value grayscale is in a range of 50 to 0, the second value grayscale is in a range of 0 to 25, wherein the green and blue gammas (γ) are adjusted from the original γG and γB to γG1 and γB1, wherein γG1>γG and γB1>γB.

3. The method for driving a display apparatus according to claim 1, wherein the green and blue gammas are adjusted, so that luminances corresponding to green and blue grayscales decrease, and luminance decrease calculation formulas are $$L'G(g)=LG(255)*(g/255)^{\gamma G1}, \text{ and}$$

$$L'B(g)=LB(255)*(g/255)^{\gamma B1}.$$

4. The method for driving a display apparatus according to claim 3, wherein grayscale g represents any grayscale.

5. The method for driving a display apparatus according to claim 3, wherein a calculation formula for adjusting a luminance corresponding to a green light source is:

$$A'n,m_G/An,m_G=LG(Ave_Gn,m)/L'G(Ave_Gn,m)=LG(255)*(Ave_Gn,m/255)\gamma G/LG(255)*(Ave_Gn,m/255)\gamma G1, \text{ wherein}$$

A'n,m_G is an adjusted green light source luminance signal, An,m_G is an initial green light source luminance signal, Ave_Gn,m is a calculated average signal of all green sub pixel units in the zone, and n and m are a column and a row where the zone is located.

6. The method for driving a display apparatus according to claim 3, wherein a calculation formula for adjusting a luminance corresponding to a blue light source is:

$$A'n,m_B/An,m_B=LB(Ave_Bn,m)/L'B(Ave_Bn,m)=LB(255)*(Ave_Bn,m/255)\gamma B/LB(255)*(Ave_Bn,m/255)\gamma B1, \text{ wherein}$$

A'n,m_B is an adjusted blue light source luminance signal, An,m_B is an initial blue light source luminance signal, Ave_Bn,m is a calculated average signal of all blue sub pixel units in the zone, and n and m are a column and a row where the zone is located.

7. An apparatus for driving a display apparatus, comprising at least one zone, wherein each zone is formed by a plurality of pixel units, and each pixel unit is formed by a red sub pixel unit, a green sub pixel unit, and a blue sub pixel unit, and comprising: calculating average signals of sub pixel units in a zone to obtain a zone red average signal, a zone green average signal, and a zone blue average signal; separately performing a green gamma adjustment and a blue gamma adjustment according to grayscale corresponding predefined ranges of the red, green, and blue average signals; and adjusting luminances of corresponding green light sources and blue light sources;

wherein regarding grayscales of the average signals, when a grayscale of the zone green average signal is a first value grayscale in a predefined range, and grayscales of the zone red average signal and the zone blue average signal are a second value grayscale in the predefined range, green and blue gammas (γ) are adjusted from original γG and γB to γG1 and γB1, wherein γG1<γG and γB1<γB, or the green and blue gammas (γ) are adjusted from the original γG and γB to γG1 and γB1, wherein γG1>γG and γB1>γB.

8. The apparatus for driving a display apparatus according to claim 7, wherein the first value grayscale and the second value grayscale in the predefined range are selected from the following groups:

a first group: when the first value grayscale is in a range of 255 to 200, the second value grayscale is in a range of 50 to 200, wherein the green and blue gammas (γ) are adjusted from the original γG and γB to γG1 and γB1, wherein γG1<γG and γB1<γB;

a first group: when the first value grayscale is in a range of 255 to 200, the second value grayscale is in a range of 0 to 50, wherein the green and blue gammas (γ) are adjusted from the original γG and γB to γG1 and γB1, wherein γG1>γG and γB1>γB;

a second group: when the first value grayscale is in a range of 200 to 150, the second value grayscale is in a range of 50 to 200, wherein the green and blue gammas (γ) are adjusted from the original γG and γB to γG1 and γB1, wherein γG1<γG and γB1<γB;

a second group: when the first value grayscale is in a range of 200 to 150, the second value grayscale is in a range of 0 to 50, wherein the green and blue gammas (γ) are adjusted from the original γG and γB to γG1 and γB1, wherein γG1>γG and γB1>γB;

a third group: when the first value grayscale is in a range of 150 to 100, the second value grayscale is in a range of 40 to 150, wherein the green and blue gammas (γ) are adjusted from the original γG and γB to γG1 and γB1, wherein γG1<γG and γB1<γB;

a third group: when the first value grayscale is in a range of 150 to 100, the second value grayscale is in a range of 0 to 40, wherein the green and blue gammas (γ) are adjusted from the original γG and γB to γG1 and γB1, wherein γG1>γG and γB1>γB;

a fourth group: when the first value grayscale is in a range of 100 to 50, the second value grayscale is in a range of 30 to 100, wherein the green and blue gammas (γ) are adjusted from the original γG and γB to γG1 and γB1, wherein γG1<γG and γB1<γB;

a fourth group: when the first value grayscale is in a range of 100 to 50, the second value grayscale is in a range of 0 to 30, wherein the green and blue gammas (γ) are adjusted from the original γG and γB to γG1 and γB1, wherein γG1>γG and γB1>γB;

a fifth group: when the first value grayscale is in a range of 50 to 0, the second value grayscale is in a range of 25 to 50, wherein the green and blue gammas (γ) are adjusted from the original γG and γB to γG1 and γB1, wherein γG1<γG and γB1<γB; and a fifth group: when the first value grayscale is in a range of 50 to 0, the second value grayscale is in a range of 0 to 25, wherein the green and blue gammas (γ) are adjusted from the original γG and γB to γG1 and γB1, wherein γG1>γG and γB1>γB.

9. The apparatus for driving a display apparatus according to claim 8, wherein the green and blue gammas are adjusted, so that luminances corresponding to green and blue grayscales decrease, and luminance decrease calculation formulas are:

$$L'G(g)=LG(255)*(g/255)\gamma G1 \text{ and } L'B(g)=LB(255)*(g/255)\gamma B1, \text{ wherein}$$

grayscale g represents any grayscale.

10. The apparatus for driving a display apparatus according to claim 8, wherein a calculation formula for adjusting a luminance corresponding to a green light source is:

$$A'n,m_G/An,m_G=LG(Ave_Gn,m)/L'G(Ave_Gn,m)=LG(255)*(Ave_Gn,m/255)\gamma G/LG(255)*(Ave_Gn,m/255)\gamma G1, \text{ wherein}$$

A'n,m_G is an adjusted green light source luminance signal, An,m_G is an initial green light source luminance signal, Ave_Gn,m is a calculated average signal of all green sub pixel units in the zone, and n and m are a column and a row where the zone is located.

11. The apparatus for driving a display apparatus according to claim 8, wherein a calculation formula for adjusting a luminance corresponding to a blue light source is:

$$A'n,m_B/An,m_B=LB(Ave_Bn,m)/L'B(Ave_Bn,m)=LB(255)*(Ave_Bn,m/255)\gamma B/LB(255)*(Ave_Bn,m/255)\gamma B1, \text{ wherein}$$

A'n,m_B is an adjusted blue light source luminance signal, An,m_B is an initial blue light source luminance signal, Ave_Bn,m is a calculated average signal of all blue sub pixel units in the zone, and n and m are a column and a row where the zone is located.

12. A display apparatus, comprising:

a display panel; and a drive apparatus, comprising at least one zone, wherein each zone is formed by a plurality of pixel units, and each pixel unit is formed by a red sub pixel unit, a green sub pixel unit, and a blue sub pixel unit, and comprising: calculating average signals of sub pixel units in a zone to obtain a zone red average signal, a zone green average signal, and a zone blue average signal; separately performing a green gamma adjustment and a blue gamma adjustment according to grayscale corresponding predefined ranges of the red, green, and blue average signals; and adjusting luminances of corresponding green light sources and blue light sources;

wherein regarding grayscales of the average signals, when a grayscale of the zone green average signal is a first value grayscale in a predefined range, and grayscales of the zone red average signal and the zone blue average signal are a second value grayscale in the predefined range, green and blue gammas (γ) are adjusted from original γG and γB to γG1 and γB1 wherein γG1<γG and γB1<γB, or the green and blue gammas (γ) are adjusted from the original γG and γB to γG1 and γB1, wherein γG1>γG and γB1>γB.

13. The display apparatus according to claim 12, wherein the first value grayscale and the second value grayscale in the predefined range are selected from the following groups:

a first group: when the first value grayscale is in a range of 255 to 200, the second value grayscale is in a range of 50 to 200, wherein the green and blue gammas (γ) are adjusted from the original γG and γB to γG1 and γB1, wherein γG1<γG and γB1<γB;

a first group: when the first value grayscale is in a range of 255 to 200, the second value grayscale is in a range of 0 to 50, wherein the green and blue gammas (γ) are adjusted from the original γG and γB to γG1 and γB1, wherein γG1>γG and γB1>γB;

a second group: when the first value grayscale is in a range of 200 to 150, the second value grayscale is in a range of 50 to 200, wherein the green and blue gammas (γ) are adjusted from the original γG and γB to γG1 and γB1, wherein γG1<γG and γB1<γB;

a second group: when the first value grayscale is in a range of 200 to 150, the second value grayscale is in a range of 0 to 50, wherein the green and blue gammas (γ) are adjusted from the original γG and γB to γG1 and γB1, wherein γG1>γG and γB1>γB;

a third group: when the first value grayscale is in a range of 150 to 100, the second value grayscale is in a range of 40 to 150, wherein the green and blue gammas (γ) are adjusted from the original γG and γB to γG1 and γB1, wherein γG1<γG and γB1<γB;

a third group: when the first value grayscale is in a range of 150 to 100, the second value grayscale is in a range of 0 to 40, wherein the green and blue gammas (γ) are adjusted from the original γG and γB to γG1 and γB1, wherein γG1>γG and γB1>γB;

a fourth group: when the first value grayscale is in a range of 100 to 50, the second value grayscale is in a range of 30 to 100, wherein the green and blue gammas (γ) are adjusted from the original γG and γB to γG1 and γB1, wherein γG1<γG and γB1<γB;

a fourth group: when the first value grayscale is in a range of 100 to 50, the second value grayscale is in a range of 0 to 30, wherein the green and blue gammas (γ) are adjusted from the original γG and γB to γG1 and γB1, wherein γG1>γG and γB1>γB;

a fifth group: when the first value grayscale is in a range of 50 to 0, the second value grayscale is in a range of 25 to 50, wherein the green and blue gammas (γ) are adjusted from the original γG and γB to γG1 and γB1, wherein γG1<γG and γB1<γB; and a fifth group: when the first value grayscale is in a range of 50 to 0, the second value grayscale is in a range of 0 to 25, wherein the green and blue gammas (γ) are adjusted from the original γG and γB to γG1 and γB1, wherein γG1>γG and γB1>γB.

14. The display apparatus according to claim 13, wherein the green and blue gammas are adjusted, so that luminances corresponding to green and blue grayscales decrease, and luminance decrease calculation formulas are:

$$L'G(g)=LG(255)*(g/255)^{\gamma G1}, \text{ and } L'B(g)=LB(255)*(g/255)^{\gamma B1}, \text{ wherein}$$

grayscale g represents any grayscale.

15. The display apparatus according to claim 13, wherein a calculation formula for adjusting a luminance corresponding to a green light source is:

$$A'n,m_G/An,m_G=LG(Ave_Gn,m)/L'G(Ave_Gn,m)=LG(255)*(Ave_Gn,m/255)^{\gamma G}/LG(255)*(Ave_Gn,m/255)^{\gamma G1}, \text{ wherein}$$

A'n,m_G is an adjusted green light source luminance signal, An,m_G is an initial green light source luminance signal, Ave_Gn,m is a calculated average signal of all green sub pixel units in the zone, and n and m are a column and a row where the zone is located.

16. The display apparatus according to claim 13, wherein a calculation formula for adjusting a luminance corresponding to a blue light source is:

$$A'n,m_B/An,m_B=LB(Ave_Bn,m)/L'B(Ave_Bn,m)=LB(255)*(Ave_Bn,m/255)^{\gamma B}/LB(255)*(Ave_Bn,m/255)^{\gamma B1}, \text{ wherein}$$

A'n,m_B is an adjusted blue light source luminance signal, An,m_B is an initial blue light source luminance signal, Ave_Bn,m is a calculated average signal of all blue sub pixel units in the zone, and n and m are a column and a row where the zone is located.

17. The display apparatus according to claim 12, wherein the drive apparatus transmits an image signal to the display panel.

* * * * *